US012655572B2

(12) United States Patent
Kim et al.

(10) Patent No.: US 12,655,572 B2
(45) Date of Patent: Jun. 16, 2026

(54) CLOTHES DRYER

(71) Applicant: SAMSUNG ELECTRONICS CO., LTD., Suwon-si (KR)

(72) Inventors: Woojin Kim, Suwon-si (KR); Junhong Park, Suwon-si (KR); Eungryeol Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 670 days.

(21) Appl. No.: 18/113,830

(22) Filed: Feb. 24, 2023

(65) Prior Publication Data

US 2023/0203744 A1 Jun. 29, 2023

Related U.S. Application Data

(63) Continuation of application No. PCT/KR2021/011258, filed on Aug. 24, 2021.

(30) Foreign Application Priority Data

Oct. 16, 2020 (KR) ..... 10-2020-0133864

(51) Int. Cl.
*D06F 58/20* (2006.01)
*D06F 58/02* (2006.01)

(52) U.S. Cl.
CPC ..... *D06F 58/206* (2013.01); *D06F 58/02* (2013.01)

(58) Field of Classification Search
CPC ..... D06F 58/02; D06F 58/206
See application file for complete search history.

(56) References Cited

U.S. PATENT DOCUMENTS

| | | | |
|---|---|---|---|
| 5,572,799 | A | 11/1996 | Masuyuki et al. |
| 10,544,540 | B2 | 1/2020 | Lee |
| 10,793,996 | B2 | 10/2020 | Seo et al. |

FOREIGN PATENT DOCUMENTS

| | | |
|---|---|---|
| EP | 2 339 063 B1 | 4/2014 |
| JP | 2007-268158 | 10/2007 |
| JP | 4268183 | 5/2009 |
| JP | 2009-247600 | 10/2009 |
| JP | 4728834 | 7/2011 |

(Continued)

OTHER PUBLICATIONS

English Translation JP 2014030664 A (Year: 2014).*

(Continued)

*Primary Examiner* — Connor J Tremarche
(74) *Attorney, Agent, or Firm* — STAAS & HALSEY LLP

(57) ABSTRACT

A clothes dryer including a cabinet, a drum rotatably installed inside the cabinet, a heat pump provided to generate hot air to be supplied to the inside of the drum, a fan provided to induce the hot air generated by the heat pump to the inside of the drum, a hot air supply duct connected to a rear surface of the drum to guide the hot air induced by the fan to the inside of the drum, a scroll provided to accommodate the fan to guide the hot air discharged from the fan to the hot air supply duct, and a discharge duct provided to connect the scroll and the hot air supply duct, wherein a rear surface of the scroll is positioned in front of a rear surface of the hot air supply duct, and the scroll is disposed obliquely in a direction of facing the rear surface of the hot air supply duct.

12 Claims, 7 Drawing Sheets

(56) References Cited

FOREIGN PATENT DOCUMENTS

| | | | | | |
|---|---|---|---|---|---|
| JP | 4848405 | | | 12/2011 | |
| JP | 4882620 | | | 2/2012 | |
| JP | 5031815 | | | 9/2012 | |
| JP | 2013-192659 | | | 9/2013 | |
| JP | 2014-30472 | | | 2/2014 | |
| JP | 2014-30664 | | | 2/2014 | |
| JP | 2014030664 | A | * | 2/2014 | ..... D06F 25/00 |
| JP | 6019391 | | | 11/2016 | |
| JP | 2018-175444 | | | 11/2018 | |
| KR | 10-0323473 | | | 6/2002 | |
| KR | 10-0434371 | | | 6/2004 | |
| KR | 10-1711869 | | | 3/2017 | |
| KR | 10-2019-0065149 | | | 6/2019 | |
| KR | 10-2019-0128466 | | | 11/2019 | |
| WO | WO 2019/233548 | A1 | | 12/2019 | |

OTHER PUBLICATIONS

International Search Report, PCT/ISA/210, dated Dec. 14, 2021, in International Application No. PCT/KR2021/011258.
Written Opinion, PCT/ISA/237, dated Dec. 14, 2021, in International Application No. PCT/KR2021/011258.
Office Action dated Aug. 12, 2025, in Korean Application No. 10-2020-0133864.

* cited by examiner

CLOTHES DRYER

CROSS-REFERENCE TO RELATED APPLICATIONS

This application is a continuation application of International Application PCT/KR2021/011258 filed Aug. 24, 2021, and claims foreign priority to Korean application 10-2020-0133864 filed Oct. 16, 2020, the disclosures of which are incorporated herein by reference in their entireties.

BACKGROUND

1. Field

The present disclosure relates to a clothes dryer having an improved passage structure for guiding hot air discharged from a fan to be supplied to the inside of a drum.

2. Description of Related Art

In general, a clothes dryer is a device for drying objects to be dried, which is wet laundry accommodated in a drum, by forcibly blowing hot air into the drum. Clothes dryers are basically similar to drum washing machines in appearance, and dry objects to be dried by forcibly circulating hot air heated through a heater and a blowing fan into the drum.

Clothes dryers may be classified into condensation type dryers and exhaust type dryers.

In the condensation type dryer, air in a humid state by heat exchange with objects to be dried in the drum is circulated without being discharged to the outside of the dryer, and the circulated air is heat-exchanged with external air in a separate condenser to generate condensate, and the generated condensate is discharged to the outside.

In the exhaust type dryer, air in a humid state by heat exchange with objects to be dried in the drum is discharged directly to the outside of the dryer.

In the case of the condensation type clothes dryer, hot air is generated by a heat pump, and the hot air is circulated inside and outside the drum by a fan. Because the hot air that is circulated must pass through the heat pump within a passage, which is a limited space, flow resistance is high, and thus a sirocco fan with a fixed pressure characteristic is mainly used. In this case, when a motor driving the fan is disposed in a passage through which the hot air is circulated, the flow resistance increases, and thus the efficiency of the fan is reduced.

Therefore, the motor is disposed at the rear of the fan outside the passage. When the motor is disposed at the rear of the fan, a space in which the motor is disposed is required at the rear of the fan as much as a size of the motor. As the space in which the motor is disposed increases, a passage of a fan discharge port is rapidly bent, and thus the flow resistance may increase.

SUMMARY

An aspect of the present disclosure provides a clothes dryer including a cabinet, a drum rotatably installed inside the cabinet, a heat pump provided to generate hot air to be supplied to the inside of the drum, a fan provided to induce the hot air generated by the heat pump to the inside of the drum, a hot air supply duct connected to a rear surface of the drum to guide the hot air induced by the fan to the inside of the drum, a scroll provided to accommodate the fan to guide the hot air discharged from the fan to the hot air supply duct, and a discharge duct provided to connect the scroll and the hot air supply duct, wherein a rear surface of the scroll is positioned in front of a rear surface of the hot air supply duct, and the scroll is disposed obliquely in a direction of facing the rear surface of the hot air supply duct.

The scroll may include a fan accommodating part in which the fan is accommodated, an inlet in front of the fan accommodating part to allow hot air to be introduced into the fan, and a discharge guide extending upward from a left side of the fan accommodating part and connected to the discharge duct to guide the hot air discharged from the fan to the discharge duct.

The scroll may be disposed obliquely toward the rear surface of the hot air supply duct so that the discharge duct is connected to the hot air supply duct to have a gentle inclination.

A fan driving motor connected to the fan to drive the fan may be disposed at a rear of the fan accommodating part, and a part of the fan driving motor may be accommodated in the fan accommodating part.

A rear surface of the fan accommodating part may be positioned in front of the rear surface of the hot air supply duct as much as a space in which the fan driving motor is disposed.

The clothes dryer may further include a duct forming a passage for guiding the hot air generated by the heat pump to the inside of the drum.

The duct may include the hot air supply duct, a hot air discharge duct for discharging the hot air passed through the inside of the drum, and a connection duct connecting the hot air supply duct and the hot air discharge duct.

A part of the heat pump may be inside the connection duct.

The fan driving motor may be disposed outside the passage.

The fan driving motor may include a fan rotation shaft connected to the fan, and the fan rotation shaft may be obliquely disposed as much as the scroll is obliquely disposed.

The fan rotation shaft may be disposed to have a different inclination from that of a rotational axis of the drum.

The fan rotation shaft may be disposed to have an angle greater than 0 degrees and less than 90 degrees with the rotational axis of the drum.

BRIEF DESCRIPTION OF THE DRAWINGS

Aspects, features, and advantages of certain embodiments of the present disclosure will be more apparent from the following description taken in conjunction with the accompanying drawings, in which.

DETAILED DESCRIPTION

Figure 1:
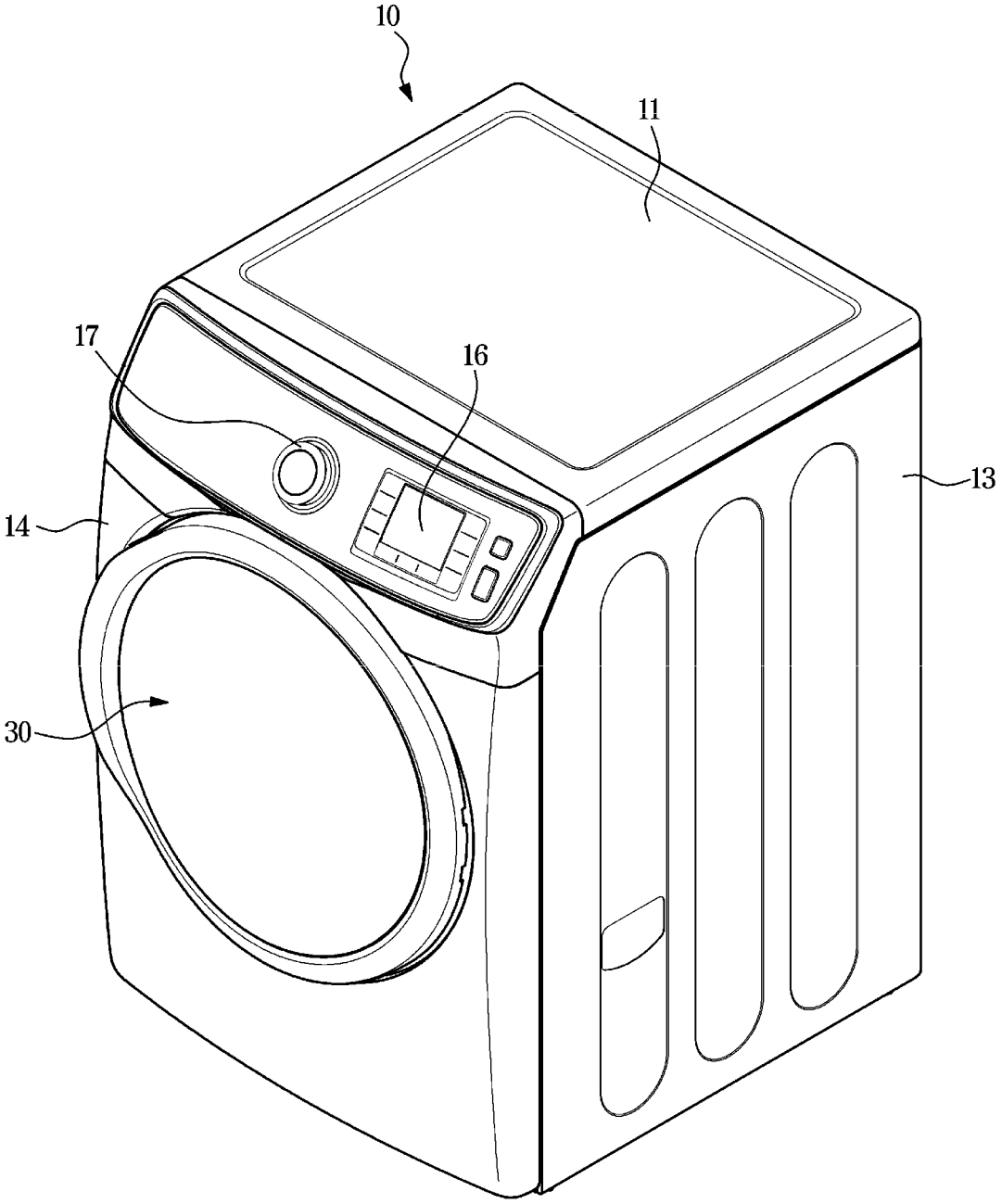
FIG. 1 is a perspective view of a clothes dryer according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context dearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms, and these terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

In this specification, the terms "front end," "rear end," "upper portion," "lower portion," "upper end" and "lower end" used in the following description are defined with reference to the drawings, and the shape and position of each component are not limited by these terms.

Various embodiments of the present disclosure are directed to providing an improved clothes dryer capable of decreasing flow resistance by minimizing bending of a passage for guiding hot air discharged from a fan to the inside of a drum.

According to various embodiments of the present disclosure, the efficiency of a fan can be improved by decreasing flow resistance.

Hereinafter, embodiments of the present disclosure will be described in detail with reference to the accompanying drawings.

Figure 2:
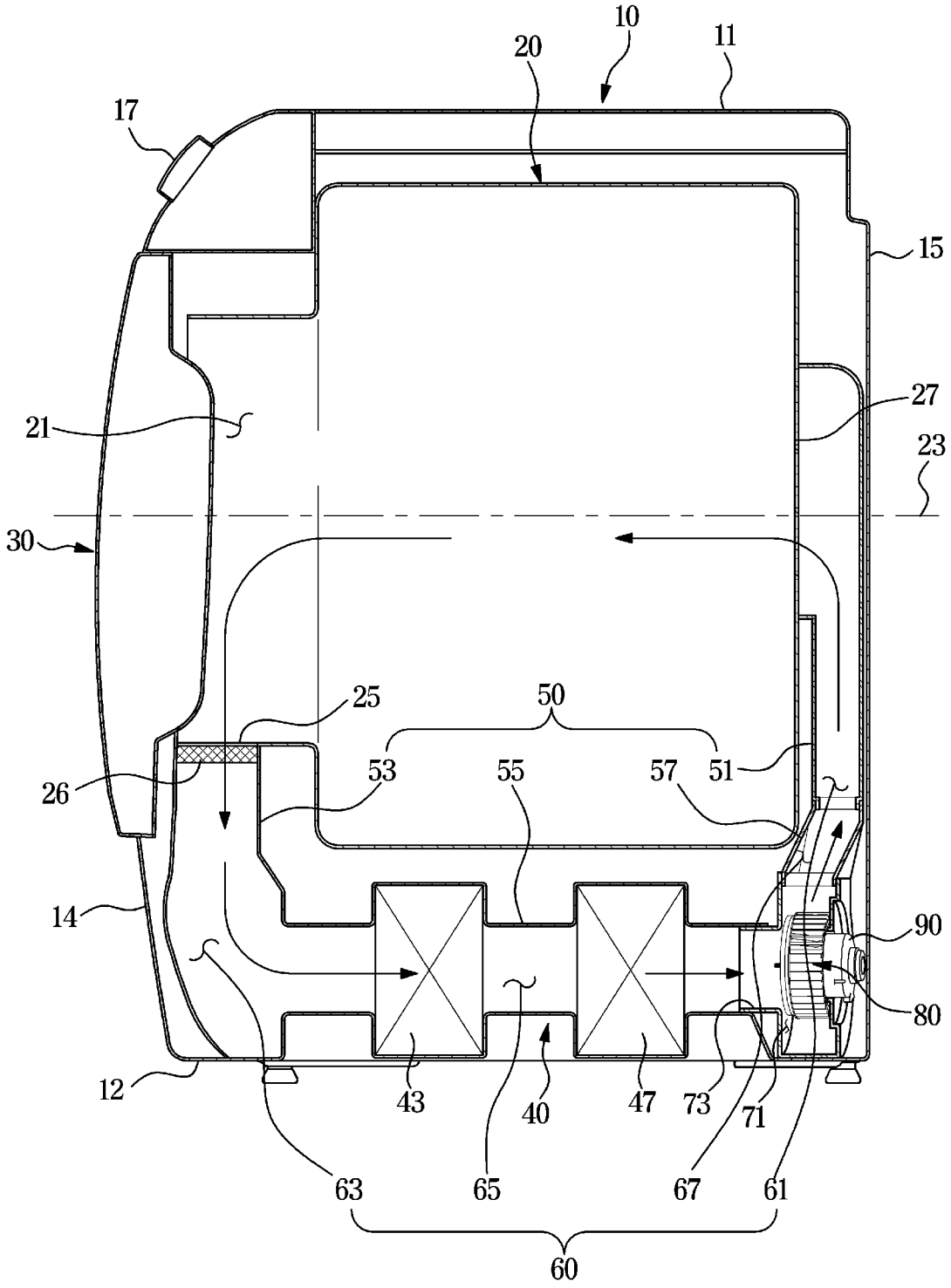
FIG. 2 is a side cross-sectional view of the clothes dryer according to an embodiment of the present disclosure.
Figure 3:
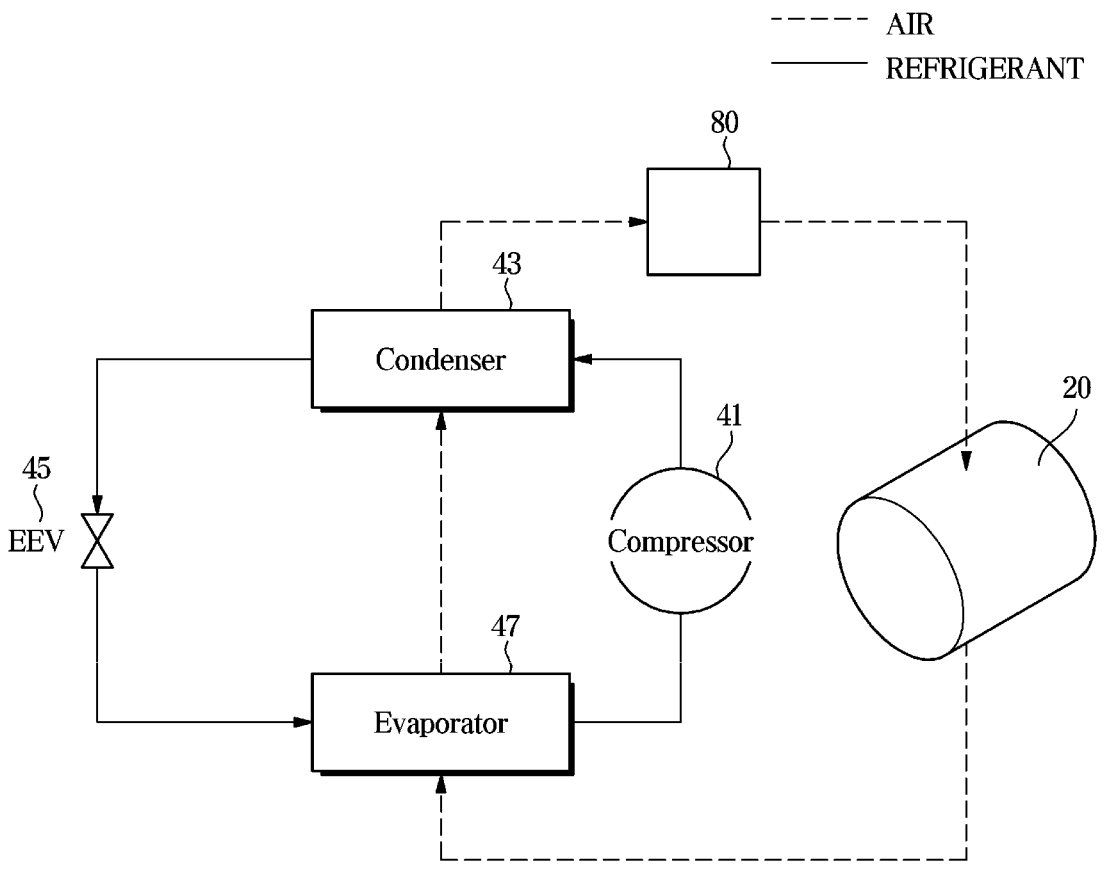
FIG. 3 is a diagram illustrating flows of a refrigerant and air of a heat pump according to an embodiment of the present disclosure.

FIG. 1 is a perspective view of a clothes dryer according to an embodiment of the present disclosure. FIG. 2 is a side cross-sectional view of the clothes dryer according to an embodiment of the present disclosure. FIG. 3 is a diagram illustrating flows of a refrigerant and air of a heat pump according to an embodiment of the present disclosure.

As illustrated in FIGS. 1 to 3, a clothes dryer may include a cabinet 10 forming an exterior, a drum 20 rotatably provided inside the cabinet 10 to accommodate objects to be dried therein, a door 30 provided on a front side of the cabinet 10 to open and close an opening 21 formed on a front side of the drum 20, and a heat pump 40 provided to generate hot air to be supplied to the inside of the drum 20.

The cabinet 10 may have a substantially box shape. Specifically, the cabinet 10 may include an upper plate 11, a lower plate 12, a left plate (not shown), a right plate 13, a front plate 14, and a rear plate 15. In this embodiment, the left plate, the right plate 13 and the rear plate 15 may be integrally formed, but are not limited thereto and may be separately formed and assembled.

A display 16 and a rotary switch 17 for controlling the clothes dryer may be disposed above the front plate 14. The rotary switch 17 may be provided such that the user may select a mode of the clothes dryer by holding and rotating it. The display 16 may display an operating state of the clothes dryer and a manipulation state of a user.

The drum 20 may be provided inside the cabinet 10 so that objects to be dried are accommodated therein. The drum 20 may be rotatably provided inside the cabinet 10. The drum 20 may be provided to be rotated about a rotational axis 23.

The drum 20 may include a discharge port 25 provided on the front side of the drum 20 and a suction port 27 provided on a rear surface of the drum 20. A duct 50, which will be described later, may connect the discharge port 25 and the suction port 27 so that hot air may be circulated from the inside to the outside of the drum 20 and from the outside to the inside of the drum 20.

The inside of the drum 20 communicates with the opening 21 so that when the opening 21 is opened through the door 30, objects to be dried may be put into the drum 20 or objects dried may be taken out from the drum 20.

The heat pump 40 may be provided to generate hot air to be supplied into the drum 20. A part of the heat pump 40 may be disposed inside the duct 50 forming a passage 60. The heat pump 40 may include a compressor 41, a condenser 43, an expansion valve 45, and an evaporator 47.

A refrigerant may circulate through the compressor 41, the condenser 43, the expansion valve 45, and the evaporator 47 to undergo a cycle consisting of compression-condensation-expansion-evaporation. The condenser 43 and the evaporator 47 may be provided in the form of a heat exchanger capable of exchanging heat with air. The compressor 41 may compress and discharge a gas refrigerant in a high-temperature and high-pressure state, the discharged gas refrigerant may be introduced into the condenser 43, and the condenser 43 may condense the compressed gas refrigerant into a liquid phase and discharge heat to the surroundings through the condensation process. The expansion valve 45 may expand a liquid refrigerant in the high-temperature and high-pressure state condensed in the condenser 43 into the liquid refrigerant in a low-pressure state. The evaporator 47 may evaporate the refrigerant expanded by the expansion valve 45 and return the gas refrigerant in a low-temperature and low-pressure state to the compressor 41. The evaporator 47 may take away heat from the surroundings through an evaporation process of changing a liquid refrigerant into a gas refrigerant. Air circulating inside the drum 20 through the duct 50 is heated while passing through the condenser 32, so that the air may be changed into hot air, which is a high-temperature and dry air.

The hot air may be induced into the drum 20 by a fan 80, which will be described later, and the hot air induced by the fan 80 may be introduced into the drum 20 through the suction port 27 to dry objects to be dried. The hot air that has taken away moisture from the objects to be dried is changed back into high-temperature and humid air containing a large amount of water vapor, and the high-temperature and humid air discharged from the drum 20 through the discharge port 25 may pass through the evaporator 47.

A filter 26 provided to collect foreign substances generated from the objects to be dried may be installed in the discharge port 25.

The temperature of the air that has been taken away heat while passing through the evaporator 47 may be lowered and the amount of water vapor contained in the air may be reduced. The high-temperature and humid air discharged from the drum 20 may be changed into low-temperature and dry air while passing through the evaporator 47. The low-temperature air dried by passing through the evaporator 47 is changed into hot air, which is high-temperature and dry air, while passing through the condenser 43 again, and may be sucked into the drum 20.

The clothes dryer may include the duct 50 forming the passage 60 for guiding hot air generated by the heat pump 40 to the inside of the drum 20.

The duct 50 may include a hot air supply duct 51 for guiding hot air to the inside of the drum 20, a hot air discharge duct 53 for discharging hot air passed through the inside of the drum 20, a connection duct 55 connecting the hot air supply duct 51 and the hot air discharge duct 53, and a discharge duct 57 connecting a scroll 70, which will be described later, and the hot air supply duct 51.

The passage 60 may include a hot air supply passage 61 formed by the hot air supply duct 51 to supply hot air to the inside of the drum 20, a hot air discharge passage 63 formed by the hot air discharge duct 53 provided to discharge hot air passed through the inside of the drum 20, a connection passage 65 connected to the hot air discharge passage 63 and formed by the connection duct 55 connecting the hot air discharge duct 53 and the hot air supply duct 51, and a discharge passage 67 formed by the discharge duct 57 to guide hot air discharged from the fan 80 to the hot air supply duct 51. The connection passage 65 may accommodate the evaporator 47 and the condenser 43 of the heat pump 40.

The hot air supply duct 51 may be disposed at the rear side of the drum 20. The hot air supply duct 51 may be connected to the suction port 27 formed on the rear surface of the drum 20. High-temperature and dry air is supplied to the inside of the drum 20 by the hot air supply duct 51, and objects to be dried inside the drum 20 may be dried by the high-temperature and dry air.

The hot air discharge duct 53 may be connected to the discharge port 25 of the drum 20. The air that has dried the objects to be dried is changed into a high-temperature and humid state, and the high-temperature and humid air in the drum 20 may be discharged to the outside of the drum 20 through the hot air discharge duct 53 connected to the discharge port 25.

The high-temperature and humid air introduced into the connection duct 55 through the hot air discharge duct 53 is guided to the evaporator 47 so that moisture in the high-temperature and humid air may be removed. The air from which moisture is removed by the evaporator 47 is heated to a high temperature by the condenser 43 and the heated hot air may be induced by the fan 80. The hot air induced by the fan 80 may be guided to the hot air supply duct 51 through the discharge duct 57. The hot air guided to the hot air supply duct 51 may be supplied to the inside of the drum 20 again.

The clothes dryer may include a scroll 70 accommodating the fan 80 and a fan driving motor 90 driving the fan 80.

Figure 4:
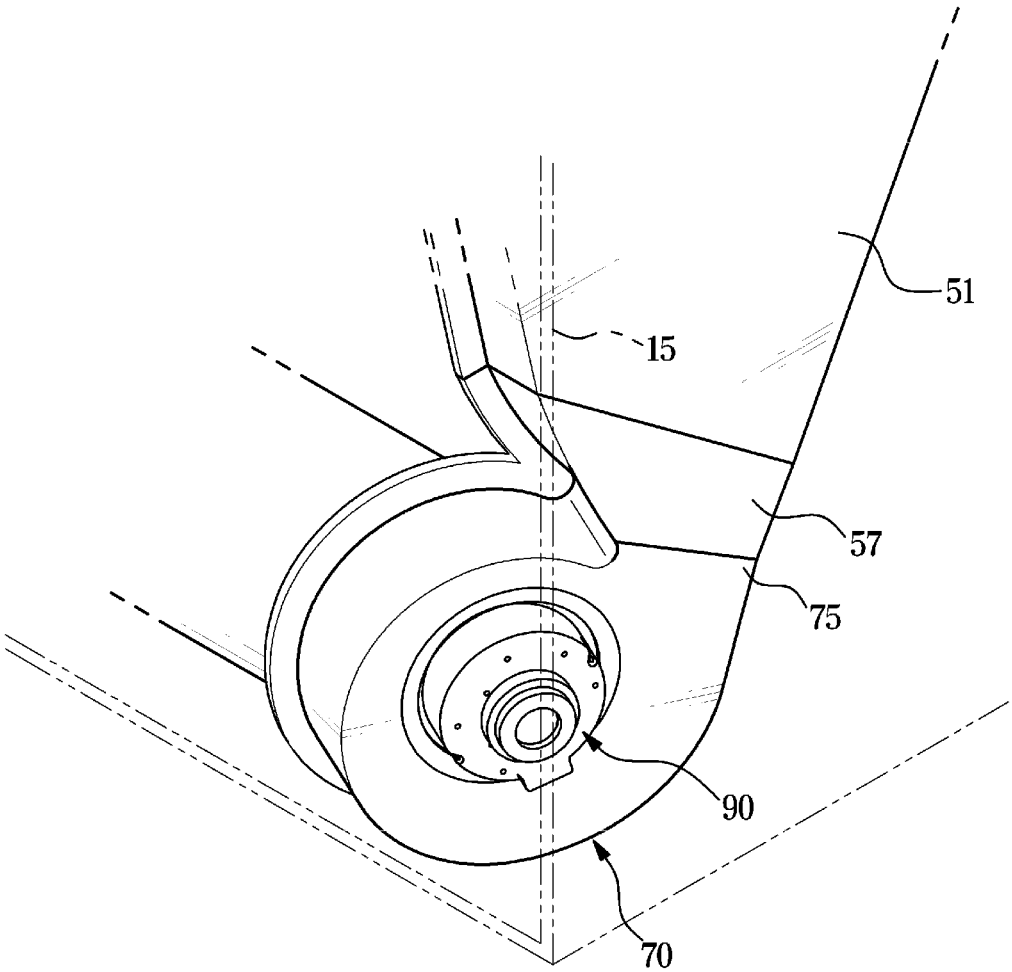
FIG. 4 is a view illustrating a state in which a scroll is obliquely disposed according to an embodiment of the present disclosure.
Figure 5:
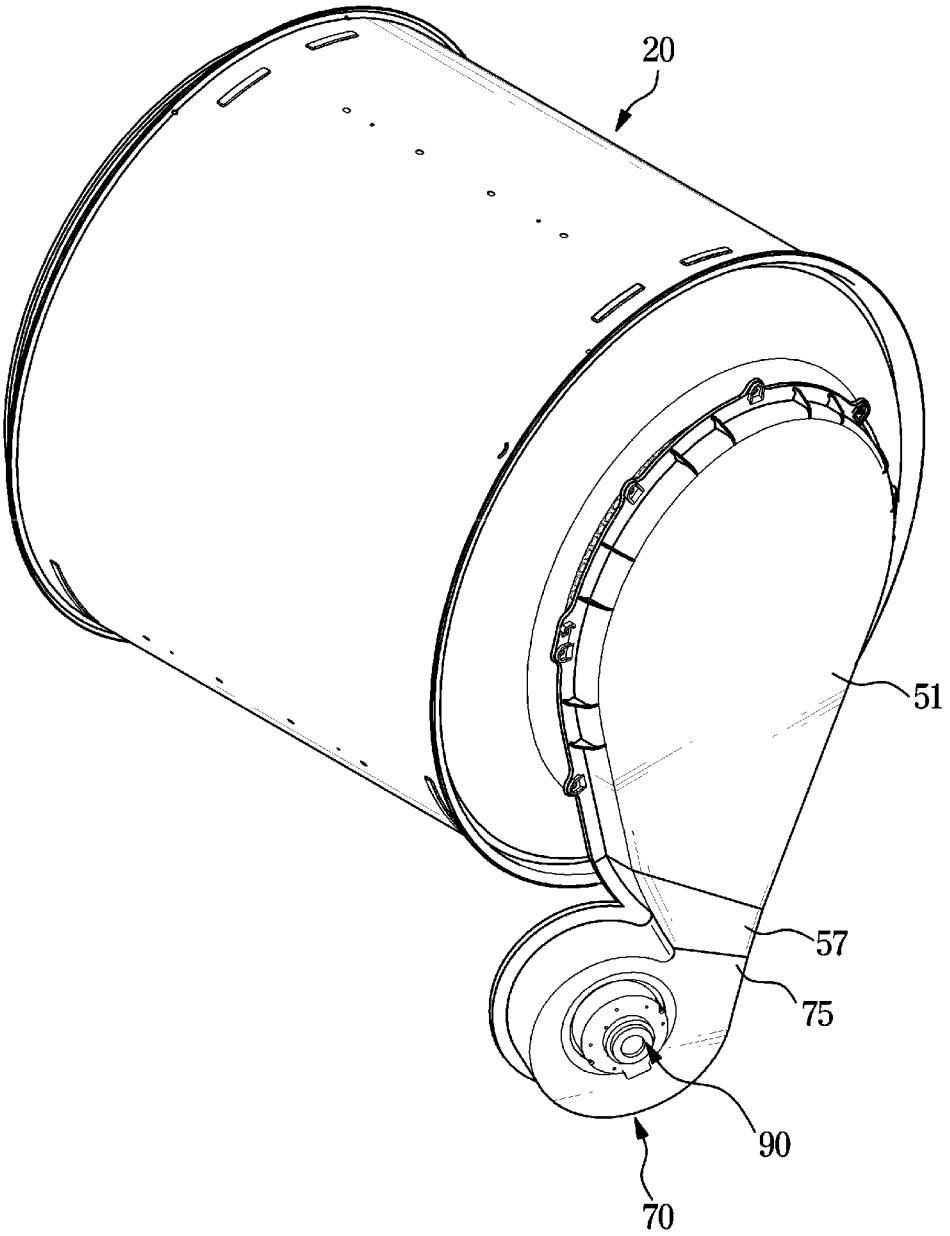
FIG. 5 is a view illustrating a state in which the scroll and a hot air supply duct are disposed at the rear of a drum according to an embodiment of the present disclosure.
Figure 6:
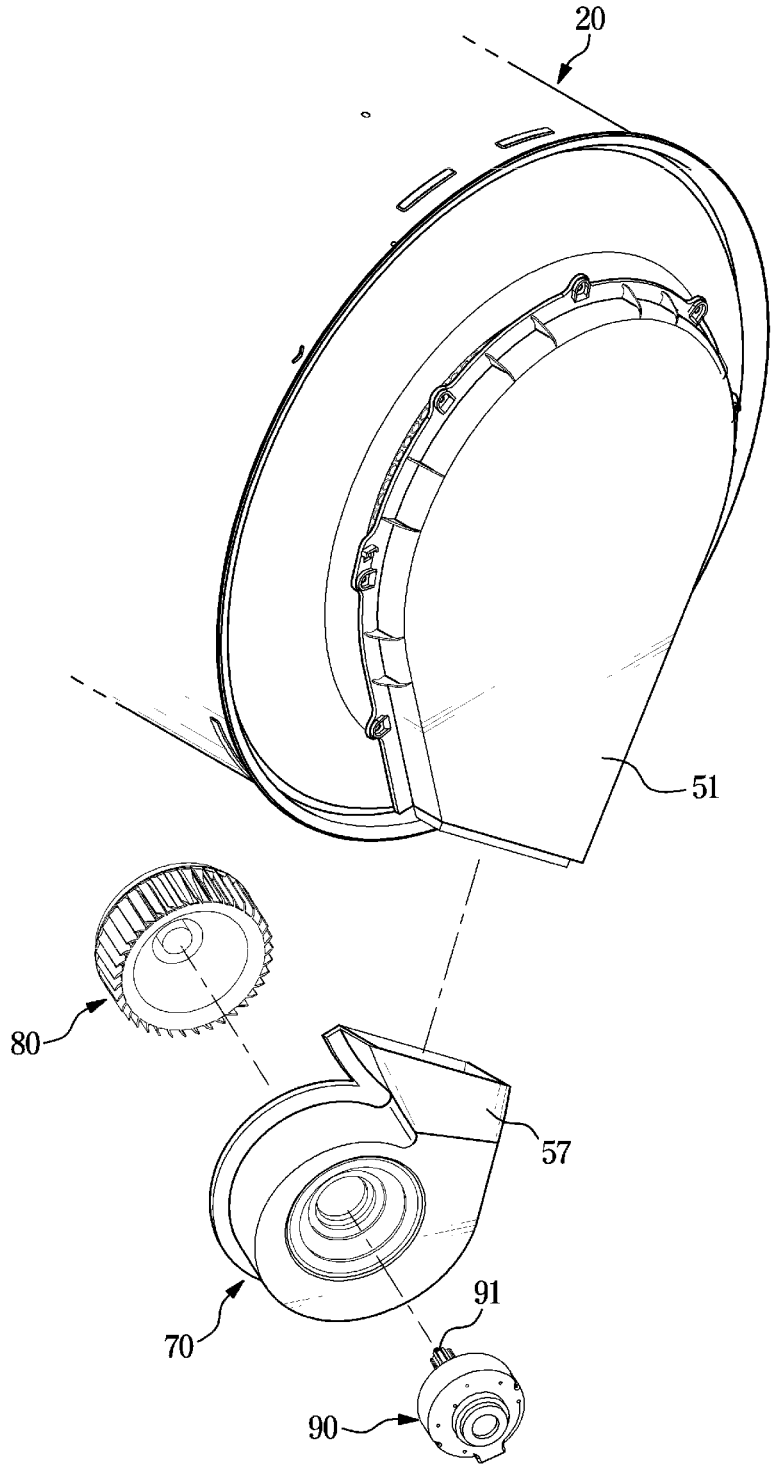
FIG. 6 is a view illustrating a state in which a fan is accommodated in the scroll and a fan driving motor is connected to the rear of the fan according to an embodiment of the present disclosure.
Figure 7:
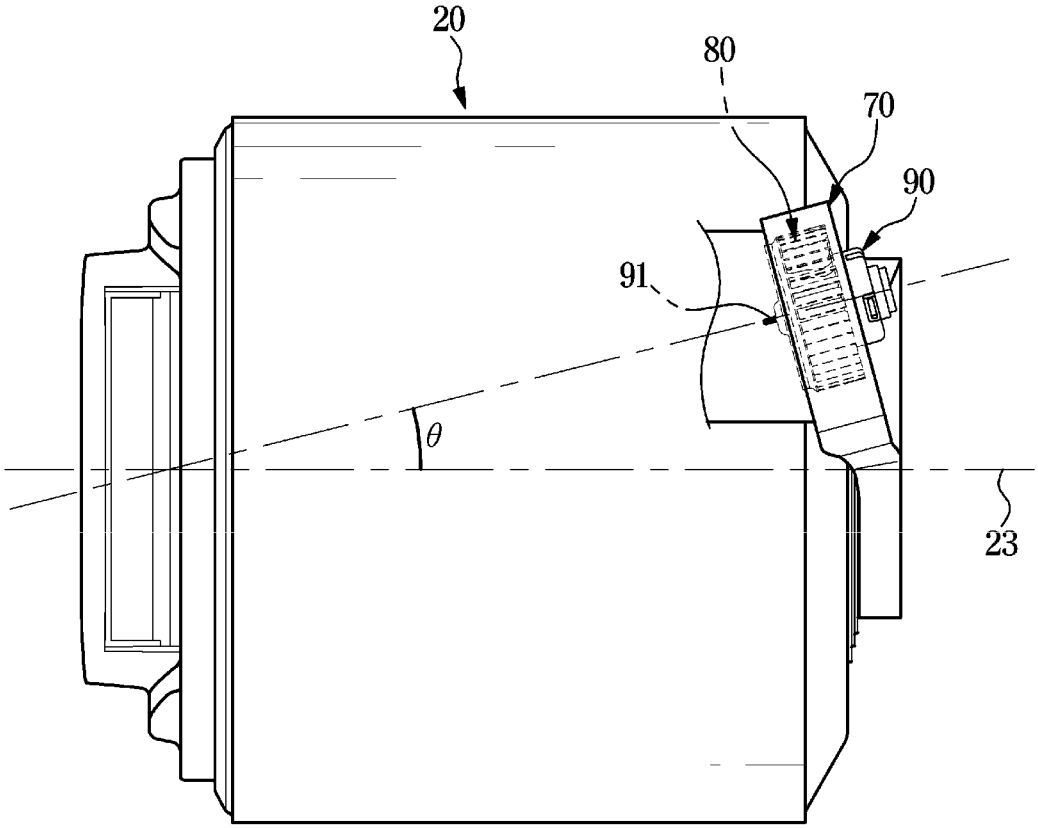
FIG. 7 is a view illustrating a state in which a fan rotational axis and a drum rotational axis are disposed to have different inclinations according to an embodiment of the present disclosure.

FIG. 4 is a view illustrating a state in which a scroll is obliquely disposed according to an embodiment of the present disclosure. FIG. 5 is a view illustrating a state in which the scroll and a hot air supply duct are disposed at the rear of a drum according to an embodiment of the present disclosure. FIG. 6 is a view illustrating a state in which a fan is accommodated in the scroll and a fan driving motor is connected to the rear of the fan according to an embodiment of the present disclosure. FIG. 7 is a view illustrating a state in which a fan rotational axis and a drum rotational axis are disposed to have different inclinations according to an embodiment of the present disclosure.

As illustrated in FIGS. 4 to 7, the scroll 70 may include a fan accommodating part 71 in which the fan 80 is accommodated, an inlet 73 provided in front of the fan accommodating part 71 to allow hot air to be introduced into the fan 80, and a discharge guide 75 for guiding hot air discharged from the fan 80 to the discharge duct 57. A rear surface of the scroll 70 may be positioned in front of a rear surface of the hot air supply duct 51. The scroll 70 may be provided such that the inlet 73 is connected to the connection duct 55 and the discharge guide 75 is connected to the discharge duct 57. Accordingly, the passage 60 formed by the duct 50 and a passage through which hot air is circulated by the scroll 70 may be provided (see FIG. 2).

The fan 80 may be accommodated in the fan accommodating part 71 of the scroll 70. Because hot air that is circulated must pass through the evaporator 47 and the condenser 43 within the passage 60, which is a limited space, flow resistance is high, and thus the fan 80 may be provided as a sirocco fan with a fixed pressure characteristic. The fan 80 may induce hot air generated by the heat pump 50 (see FIG. 2) to the inside of the drum 20. The hot air generated by the heat pump 50 (see FIG. 2) may be introduced into the fan 80 through the inlet 73 of the scroll 70. The hot air introduced into the fan 80 may be discharged through the discharge guide 75. The hot air discharged through the discharge guide 75 may be supplied to the inside of the drum 20 through the discharge duct 57 and the hot air supply duct 51.

The fan driving motor 90 driving the fan 80 may be disposed at the rear of the fan 80. The fan driving motor 90 may include a fan rotation shaft 91 connected to the fan 80. The fan driving motor 90 may be disposed outside the passage 60. Because when the fan driving motor 90 is disposed inside the passage 60, hot air that is circulated must pass through the fan driving motor 90 within the passage 60, which is a limited space, the flow resistance is high, and thus the efficiency of the fan 80 may be reduced. Therefore, the fan driving motor 90 may be disposed at the rear of the fan 80, which is disposed outside passage 60.

A part of the fan driving motor 90 may be provided to be accommodated inside the scroll 70. Although a part of the fan driving motor 90 is accommodated inside the scroll 70, the remaining part may protrude to the rear of the scroll 70. The rear surface of the scroll 70 may be positioned in front of the rear surface of the hot air supply duct 51 by a size of the fan driving motor 90 protruding to the rear of the scroll 70. As the distance between the rear surface of the scroll 70 and the rear surface of the hot air supply duct 51 increases, the discharge duct 57 connecting the scroll 70 and the hot air supply duct 51 may be disposed to have a steep inclination. When the discharge duct 57 has a steep inclination, the flow resistance in the discharge passage 67 may increase by that much. In particular, because an area of the discharge passage 67 is small, a flow velocity therein is fast, so that the flow resistance may greatly increase even if the discharge duct 57, which guides the hot air discharged from the fan 80, is slightly bent (see FIG. 2).

When the flow resistance increases, the efficiency of the fan 80 may decrease. That is, in order to obtain the same air volume, a number of revolutions of the fan 80 must be increased, and this may increase energy for rotating the fan 80 and noise.

In order to decrease the flow resistance in the discharge passage 67, the discharge duct 57 may be provided to have a gentle inclination. In order for the discharge duct 57 to have a gentle inclination, the scroll 70 may be disposed obliquely in a direction of facing the rear surface of the hot air supply duct 51. That is, in FIG. 4, the rear surface of the scroll 70 may be disposed obliquely in the direction of facing the rear surface of the hot air supply duct 51 based on a front surface of the scroll 70. When the scroll 70 is disposed obliquely in the direction of facing the rear surface of the hot air supply duct 51, the discharge duct 57 connecting the scroll 70 and the hot air supply duct 51 may be provided to have a gentle inclination by that much.

Because when the discharge duct 57 is provided to have a gentle inclination, the flow resistance in the discharge passage 67 decreases, the number of revolutions of the fan 80 may be reduced under a condition of obtaining the same air volume. That is, energy consumed to rotate the fan 80 may be reduced by reducing the number of revolutions of the fan 80. In addition, the air volume may be increased under a condition that the number of revolutions of the fan 80 is the same.

Because the scroll 70 is disposed obliquely in the direction of facing the rear surface of the hot air supply duct 51, the fan 80 accommodated inside the scroll 70 may also be disposed obliquely in the direction of facing the rear surface of the hot air supply duct 51. Accordingly, the fan rotation shaft 91 of the fan driving motor 90 connected to the fan 80 may also be disposed obliquely. That is, the fan rotation shaft 91 may be disposed to have a different inclination from the rotational axis 23 of the drum 20.

The fan rotation shaft 91 may be disposed to have an angle θ greater than 0 degrees and less than 90 degrees with the rotational axis 23 of the drum 20. An angle between the fan rotation shaft 91 and the rotational axis 23 of the drum 20 may be determined depending on the size of the fan driving motor 90. That is, because the distance between the rear surface of the scroll 70 and the rear surface of the hot air supply duct 51 increases when the size of the fan driving motor 90 becomes large, the angle between the fan rotation shaft 91 and the rotational axis 23 of the drum 20 may be increased. In addition, because the distance between the rear surface of the scroll 70 and the rear surface of the hot air supply duct 51 decreases when the size of the fan driving motor 90 becomes small, the angle between the fan rotation shaft 91 and the rotational axis 23 of the drum 20 may be decreased.

Although a clothes dryer has been described above with reference to the accompanying drawings, focusing on its specific shape and direction, various modifications and changes are possible by those skilled in the art, and these modifications and changes should be interpreted to be included in the scope of rights of the present disclosure.

What is claimed is:

1. A clothes dryer comprising:

a cabinet including a front, a rear, a top, a bottom, a first side, and a second side;

a drum rotatably installed inside the cabinet;

a heat pump provided to generate hot air to be supplied to an inside of the drum;

a fan provided to induce the hot air generated by the heat pump to the inside of the drum;

a hot air supply duct connected to a rear surface of the drum to guide the hot air induced by the fan to the inside of the drum;

a scroll provided to accommodate the fan to guide the hot air discharged from the fan to the hot air supply duct; and a discharge duct provided to connect the scroll and the hot air supply duct, wherein a rear surface of the scroll is positioned in front of a rear surface of the hot air supply duct, and the scroll is disposed obliquely in a direction of facing the rear surface of the hot air supply duct so that a rotational axis of the fan is angled toward the first side or the second side of the cabinet.

2. The clothes dryer according to claim 1, wherein the scroll includes a fan accommodating part in which the fan is accommodated, an inlet in front of the fan accommodating part to allow hot air to be introduced into the fan, and a discharge guide extending upward from a left side of the fan accommodating part and connected to the discharge duct to guide the hot air from the fan to the discharge duct.

3. The clothes dryer according to claim 2, wherein the scroll is disposed obliquely toward the rear surface of the hot air supply duct so that the discharge duct is connected to the hot air supply duct to have an inclination toward the rear surface of the hot air supply duct.

4. The clothes dryer according to claim 2, further comprising:

a fan driving motor connected to the fan to drive the fan, and disposed at a rear of the fan accommodating part, wherein a part of the fan driving motor is accommodated in the fan accommodating part.

5. The clothes dryer according to claim 4, wherein a rear surface of the fan accommodating part is positioned in front of the rear surface of the hot air supply duct as much as a space in which the fan driving motor is disposed.

6. The clothes dryer according to claim 4, further comprising:

a duct forming a passage for guiding the hot air generated by the heat pump to the inside of the drum.

7. The clothes dryer according to claim 6, wherein the duct includes the hot air supply duct, a hot air discharge duct for discharging the hot air passed through the inside of the drum, and a connection duct connecting the hot air supply duct and the hot air discharge duct.

8. The clothes dryer according to claim 7, wherein a part of the heat pump is inside the connection duct.

9. The clothes dryer according to claim 7, wherein the fan driving motor is disposed outside the passage.

10. The clothes dryer according to claim 4, wherein the fan driving motor includes a fan rotation shaft connected to the fan, and the fan rotation shaft is obliquely disposed as much as the scroll is obliquely disposed.

11. The clothes dryer according to claim 10, wherein the fan rotation shaft is disposed to have a different inclination from that of a rotational axis of the drum.

12. The clothes dryer according to claim 11, wherein the fan rotation shaft is disposed to have an angle greater than 0 degrees and less than 90 degrees with the rotational axis of the drum.

* * * * *